US009862471B1

(12) United States Patent
Taylor et al.

(10) Patent No.: US 9,862,471 B1
(45) Date of Patent: Jan. 9, 2018

(54) SYSTEMS AND METHODS FOR POSITIONING MULTIPLE TRIMMABLE MARINE PROPULSION DEVICES ON A MARINE VESSEL

(71) Applicant: Brunswick Corporation, Lake Forest, IL (US)

(72) Inventors: Brad E. Taylor, Dallas, TX (US); Steven J. Andrasko, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/180,620

(22) Filed: Jun. 13, 2016

Related U.S. Application Data

(60) Provisional application No. 62/183,398, filed on Jun. 23, 2015.

(51) Int. Cl.
*B63H 20/10* (2006.01)
*B63H 20/00* (2006.01)

(52) U.S. Cl.
CPC ..... *B63H 20/10* (2013.01); *B63H 2020/003* (2013.01)

(58) Field of Classification Search
CPC ..... B63H 20/10; B63H 2020/003
USPC ..... 701/21
See application file for complete search history.

(56) References Cited

U.S. PATENT DOCUMENTS 3,682,127 A 8/1972 Waquet
3,777,694 A 12/1973 Best
3,834,345 A 9/1974 Hager et al.
3,999,502 A 12/1976 Mayer
4,050,359 A 9/1977 Mayer
4,318,699 A 3/1982 Wenstadt et al.
(Continued)

FOREIGN PATENT DOCUMENTS

EP 2368791 1/2013

OTHER PUBLICATIONS

Andrasko et al., "Systems and Methods for Providing Notification Regarding Trim Angle of a Marine Propulsion Device", Unpublished U.S. Appl. No. 14/573,200, filed Dec. 17, 2014.
(Continued)

*Primary Examiner* — Brian P Sweeney
(74) *Attorney, Agent, or Firm* — Andrus Intellectual Property Law, LLP

(57) ABSTRACT

A controller carries out a method for positioning multiple trimmable marine propulsion devices on a marine vessel transom. The method includes identifying two propulsion devices located one on either side of a transom centerline and defining these as outer propulsion devices. A third propulsion device coupled to the transom between the outer propulsion devices is defined as an inner propulsion device. A user input is received to trim the outer and inner propulsion devices in a single direction with respect to their current trim angles. In response to the user input, the controller outputs a control signal. In response to the control signal, the outer propulsion devices are trimmed in the single direction to a first trim angle and the inner propulsion device is trimmed in the single direction to a second, different trim angle. The controller may rate limit trimming of the outer propulsion devices to accomplish this.

20 Claims, 5 Drawing Sheets

(56) References Cited

U.S. PATENT DOCUMENTS

| | | | |
|---|---|---|---|
| 4,413,215 | A | 11/1983 | Cavil et al. |
| 4,490,120 | A | 12/1984 | Hundertmark |
| 4,565,528 | A | 1/1986 | Nakase |
| 4,718,872 | A | 1/1988 | Olson et al. |
| 4,749,926 | A | 6/1988 | Ontolchik |
| 4,776,818 | A | 10/1988 | Cahoon et al. |
| 4,824,407 | A | 4/1989 | Torigai et al. |
| 4,836,810 | A | 6/1989 | Entringer |
| 4,861,292 | A | 8/1989 | Griffiths et al. |
| 4,872,857 | A | 10/1989 | Newman et al. |
| 4,898,563 | A | 2/1990 | Torigai et al. |
| 4,908,766 | A | 3/1990 | Takeuchi |
| 4,931,025 | A | 6/1990 | Torigai et al. |
| 4,939,660 | A | 7/1990 | Newman et al. |
| 4,940,434 | A | 7/1990 | Kiesling |
| 4,957,457 | A | 9/1990 | Probst et al. |
| 5,007,866 | A | 4/1991 | Okita |
| 5,113,780 | A | 5/1992 | Bennett et al. |
| 5,118,315 | A | 6/1992 | Funami et al. |
| 5,142,473 | A | 8/1992 | Davis |
| 5,171,172 | A | 12/1992 | Heaton et al. |
| 5,263,432 | A | 11/1993 | Davis |
| 5,352,137 | A | 10/1994 | Iwai et al. |
| 5,366,393 | A | 11/1994 | Uenage et al. |
| 5,385,110 | A | 1/1995 | Bennett et al. |
| 5,474,012 | A | 12/1995 | Yamada et al. |
| 5,474,013 | A | 12/1995 | Wittmaier |
| 5,507,672 | A | 4/1996 | Imaeda |
| 5,540,174 | A | 7/1996 | Kishi et al. |
| 5,647,780 | A | 7/1997 | Hosoi |
| 5,683,275 | A | 11/1997 | Nanami |
| 5,707,263 | A | 1/1998 | Eick et al. |
| 5,785,562 | A | 7/1998 | Nestvall |
| 5,832,860 | A | 11/1998 | Lexau |
| 5,879,209 | A | 3/1999 | Jones |
| 6,007,391 | A | 12/1999 | Eilert |
| 6,095,077 | A | 8/2000 | DeAgro |
| 6,167,830 | B1 | 1/2001 | Pilger |
| 6,273,771 | B1 | 8/2001 | Buckley et al. |
| 6,298,824 | B1 | 10/2001 | Suhre |
| 6,322,404 | B1 | 11/2001 | Magee et al. |
| 6,354,237 | B1 | 3/2002 | Gaynor et al. |
| 6,458,003 | B1 | 10/2002 | Krueger |
| 6,583,728 | B1 | 6/2003 | Staerzl |
| 6,587,765 | B1 | 7/2003 | Graham et al. |
| 6,733,350 | B2 | 5/2004 | Lida et al. |
| 6,745,715 | B1 | 6/2004 | Shen et al. |
| 6,994,046 | B2 | 2/2006 | Kaji et al. |
| 6,997,763 | B2 | 2/2006 | Kaji |
| 7,142,955 | B1 | 11/2006 | Kern et al. |
| 7,143,363 | B1 | 11/2006 | Gaynor et al. |
| 7,156,709 | B1 | 1/2007 | Staerzl et al. |
| 7,188,581 | B1 | 3/2007 | Davis et al. |
| 7,311,058 | B1 | 12/2007 | Brooks et al. |
| 7,347,753 | B1 | 3/2008 | Caldwell et al. |
| 7,389,165 | B2 | 6/2008 | Kaji |
| 7,416,456 | B1 | 8/2008 | Gonring et al. |
| 7,462,082 | B2 | 12/2008 | Kishibata et al. |
| 7,530,865 | B2 | 5/2009 | Kado et al. |
| 7,543,544 | B2 | 6/2009 | Yap |
| 7,617,026 | B2 | 11/2009 | Gee et al. |
| 7,641,525 | B2 | 1/2010 | Morvillo |
| 7,942,711 | B1 | 5/2011 | Swan |
| 7,958,837 | B1 | 6/2011 | Fraleigh |
| 7,972,243 | B2 | 7/2011 | Kado et al. |
| 8,011,982 | B1 | 9/2011 | Baier et al. |
| 8,113,892 | B1 | 2/2012 | Gable et al. |
| 8,145,370 | B2 | 3/2012 | Borrett |
| 8,216,007 | B2 | 7/2012 | Moore |
| 8,261,682 | B1 | 9/2012 | DeVito |
| 8,376,791 | B2 | 2/2013 | Chiecchi |
| 8,376,793 | B2 | 2/2013 | Chiecchi |
| 8,388,390 | B2 | 3/2013 | Kuriyagawa et al. |
| 8,428,799 | B2 | 4/2013 | Cansiani et al. |
| 8,444,446 | B2 | 5/2013 | Kuriyagawa et al. |
| 8,457,820 | B1 | 6/2013 | Gonring |
| 8,480,445 | B2 | 7/2013 | Morvillo |
| 8,583,300 | B2 | 11/2013 | Oehlgrien et al. |
| 8,622,777 | B1 | 1/2014 | McNalley et al. |
| 8,631,753 | B2 | 1/2014 | Morvillo |
| 8,740,658 | B2 | 6/2014 | Kuriyagawa |
| 8,762,022 | B1 | 6/2014 | Arbuckle et al. |
| 8,807,059 | B1 | 8/2014 | Samples et al. |
| 8,840,439 | B1 | 9/2014 | Wiatrowski et al. |
| 8,855,890 | B2 | 10/2014 | Egle et al. |
| 8,858,278 | B2 | 10/2014 | Morvillo |
| 9,052,717 | B1 | 6/2015 | Walser et al. |
| 9,068,855 | B1 | 6/2015 | Guglielmo |
| 9,278,740 | B1 | 3/2016 | Andrasko et al. |
| 9,290,252 | B1 | 3/2016 | Tuchscherer et al. |
| 9,381,989 | B1 | 7/2016 | Poirier |
| 9,517,825 | B1 | 12/2016 | Anschuetz et al. |
| 9,598,160 | B2 | 3/2017 | Andrasko et al. |
| 2002/0174818 | A1 | 11/2002 | Von Wolske |
| 2003/0013359 | A1 | 1/2003 | Takada |
| 2004/0224577 | A1 | 11/2004 | Kaji |
| 2005/0245147 | A1 | 1/2005 | Yoshihara |
| 2007/0089660 | A1 | 4/2007 | Bradley et al. |
| 2010/0248560 | A1 | 9/2010 | Ito et al. |
| 2011/0151732 | A1* | 6/2011 | Chiecchi ..... B63B 39/061 440/84 |
| 2011/0195816 | A1* | 8/2011 | Martin ..... B60W 10/06 477/115 |
| 2011/0263167 | A1 | 10/2011 | Chiecchi |
| 2013/0312651 | A1 | 11/2013 | Gai |
| 2013/0340667 | A1 | 12/2013 | Morvillo |
| 2014/0209007 | A1 | 7/2014 | Morvillo |
| 2014/0224166 | A1 | 8/2014 | Morvillo |
| 2014/0295717 | A1 | 10/2014 | Kuriyagawa et al. |
| 2016/0068247 | A1 | 3/2016 | Morvillo |

OTHER PUBLICATIONS

Poirier, Brian, "System and Method for Positioning a Drive Unit on a Marine Vessel," Unpublished U.S. Appl. No. 14/177,767, filed Feb. 11, 2014.

Andrasko et al., "Systems and Methods for Controlling Movement of Drive Units on a Marine Vessel", Unpublished U.S. Appl. No. 14/177,762, filed Feb. 11, 2014.

Andrasko et al., "Systems and Methods for Automatically Controlling Attitude of a Marine Vessel with Trim Devices", Unpublished U.S. Appl. No. 14/873,803, filed Oct. 2, 2015.

Mercury Marine, 90-8M0076286 JPO Service Manual—Auto Trim Portion, Theory of Operation, Jul. 2013, p. 2A-5.

Mercury Marine, 90-8M0081623 JPO Owners Manual—Auto Trim Portion, Section 2—On the Water, May 2013, p. 21.

Dengel et al., "Trim Control Systems and Methods for Marine Vessels", Unpublished U.S. Appl. No. 13/770,591, filed Feb. 19, 2013.

Anschuetz et al., "System and Method for Trimming a Trimmable Marine Device with Respect to a Marine Vessel", Unpublished U.S. Appl. No. 15/003,326, filed Jan. 21, 2016.

Anschuetz et al., "System and Method for Trimming Trimmable Marine Devices with Respect to a Marine Vessel", Unpublished U.S. Appl. No. 15/003,335, filed Jan. 21, 2016.

Mercury Marine, SmartCraft Manual, p. 2A-5, 2013.

Mercury Marine, SmartCraft Manual, p. 21, 2013.

Mercury Marine, 90-8M0081632 "Joystick Piloting for Outboards", 2013, 52 pages.

* cited by examiner

SYSTEMS AND METHODS FOR POSITIONING MULTIPLE TRIMMABLE MARINE PROPULSION DEVICES ON A MARINE VESSEL

CROSS REFERENCE TO RELATED APPLICATION

The present application claims the benefit of U.S. Provisional Application Ser. No. 62/183,398, filed Jun. 23, 2015, which is hereby incorporated herein by reference.

FIELD

The present disclosure relates to systems and methods for positioning multiple trimmable devices, such as outboard motors or sterndrives, coupled to a transom of a marine vessel.

BACKGROUND

Each of the below U.S. patents and applications is hereby incorporated herein by reference.

U.S. Pat. No. 4,050,359 discloses a hydraulic system for a combined power trim and shock absorbing piston-cylinder unit of an outboard motor that includes a reversible pump means having a trim-up port connected by a pressure responsive pilot valve piston cylinder units and a trim-down port through a reverse lock solenoid valve and a down-pilot spool valve providing full drain flow for trim-up and power flow for trim-down. An up-reverse pilot valve with a pressure operator is in parallel with the reverse lock valve and provides a restricted by-pass for limited trim-up in reverse. The trim-up hydraulic input or powered side of the cylinder units define a trapped hydraulic system creating memory in the system so after impact the motor returns to the original trim position. The return side permits relatively free-flow to permit trail-out under low impact. At high speed impact, the flow is restricted and cylinder pressure increases. At a selected point, a shock valve within the piston-cylinder opens and absorbs the shock forces. The piston unit includes an inner floating head telescoped into a head secured to the piston rod with a chamber thereby formed to store the liquid flow during shock movement. A metered orifice and check valve allows return to the original trim-set position.

U.S. Pat. No. 4,318,699 discloses a sensor that responds to the operation of a marine transportation system to sense on-plane and off-plane conditions of a boat to operate a trim control to automatically position a trimmable drive for a desired boating operation. The preferred embodiment senses engine speed while an alternative embodiment senses fluid pressure opposing boat movement. The drive is moved to an auto-out position at high speeds and to a trimmed-in position at lower speeds.

U.S. Pat. No. 4,490,120 discloses a hydraulic system for trimming and tilting an outboard propulsion unit, which includes both trim piston-cylinder units and a trim-tilt piston-cylinder unit. The flow of hydraulic fluid from the reversible pump is controlled by a spool valve. A pressure relief valve is mounted in the spool to maintain pressure on one side of the spool when the pump is turned off to rapidly close the return valve and prevent further movement of the piston-cylinder units.

U.S. Pat. No. 4,776,818 discloses an electrical control system for trimming a pair of stern motors or drives mounted side-by-side on a boat. The two drives are both jointly and independently movable through a plurality of trim positions.

The system includes two trim cylinders, each coupled to one associated drive, to move its associated drive to different trim positions both jointly as well as independently of each other. An operator controlled mechanism energizes and de-energizes the two trim cylinders simultaneously to jointly vary the trim position of the two drives. Two lines, each coupled at its first end to one associated drive, independently detect both the angular trim position of its associated drive with respect to the other drive as well as detect the trim position of the two drives jointly. Automatic control means coupled to the second end of each of the two lines is responsive to the two lines, when the two drives are not in the desired equal trim position with respect to each other, and controls switches to inactivate one of the trim cylinders and thereby move the other of the trim cylinders with respect to the inactivated one trim cylinder until the desired equal trim position is achieved between the two drives.

U.S. Pat. No. 4,861,292 discloses a system for optimizing the speed of a boat at a particular throttle setting that utilizes sensed speed changes to vary the boat drive unit position vertically and to vary the drive unit trim position. The measurement of boat speed before and after an incremental change in vertical position or trim is used in conjunction with a selected minimum speed change increment to effect subsequent alternate control strategies. Depending on the relative difference in before and after speeds, the system will automatically continue incremental movement of the drive unit in the same direction, hold the drive unit in its present position, or move the drive unit an incremental amount in the opposite direction to its previous position. The alternate control strategies minimize the effects of initial incremental movement in the wrong direction, eliminate excessive position hunting by the system, and minimize drive unit repositioning which has little or no practical effect on speed.

U.S. Pat. No. 6,007,391 discloses an automatically adjustable trim system for a marine propulsion system that provides automatic trimming of the propeller in response to increased loads on the propeller. A propulsion unit is attached to a boat transom through a tilt mechanism including a transom bracket and a swivel bracket. In a first embodiment, the transom bracket is clamped to a flexible transom which flexes in response to forces exerted on the transom during acceleration. In a second embodiment, the transom bracket is clamped to a transom bracket mounting platform that is generally parallel to and pivotally attached to the transom. A trim angle biasing mechanism is mounted between the transom and the transom bracket mounting platform for automatically adjusting the trim angle. A third embodiment includes a trim angle biasing mechanism incorporated into the transom bracket or swivel bracket. A fourth embodiment includes a spring-loaded pawl assembly between the swivel bracket and transom bracket.

U.S. Pat. No. 7,347,753 discloses a hydraulic system for a sterndrive marine propulsion device that directs the flow of hydraulic fluid through the body and peripheral components of a gimbal ring in order to reduce the number and length of flexible hydraulic conduits necessary to conduct pressurized hydraulic fluid from a pump to one or more hydraulic cylinders used to control the trim or tilt of a marine drive unit relative to a gimbal housing.

U.S. Pat. No. 7,416,456 discloses an automatic trim control system that changes the trim angle of a marine propulsion device as a function of the speed of the marine vessel relative to the water in which it is operated. The changing of the trim angle occurs between first and second speed magnitudes which operate as minimum and maximum speed thresholds.

Unpublished U.S. patent application Ser. No. 14/873,803, filed Oct. 2, 2015, and assigned to the Applicant of the present application, discloses systems and methods for controlling position of a trimmable drive unit with respect to a marine vessel. A controller determines a target trim position as a function of vessel or engine speed. An actual trim position is measured and compared to the target trim position. The controller sends a control signal to a trim actuator to trim the drive unit toward the target trim position if the actual trim position is not equal to the target trim position and if at least one of the following is true: a defined dwell time has elapsed since a previous control signal was sent to the trim actuator to trim the drive unit; a given number of previous control signals has not been exceeded in an attempt to achieve the target trim position; and a difference between the target trim position and the actual trim position is outside of a given deadband. The method may include sending a second control signal for a defined brake time to trim the drive unit in an opposite, second direction in response to a determination that the actual trim position has one of achieved and exceeded the target trim position.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter According to one example of the present disclosure, a method for positioning three or more trimmable marine propulsion devices coupled to a transom of a marine vessel is carried out by a controller. The method includes identifying two propulsion devices located one on each of a port side and a starboard side of a vertical centerline of the transom and spaced symmetrically with respect to the centerline of the transom, and defining the two propulsion devices as outer propulsion devices. The method also includes identifying a third propulsion device coupled to the transom between the outer propulsion devices and defining the third propulsion device as an inner propulsion device. A user input is received to trim each of the outer and inner propulsion devices in a single direction with respect to current trim angles of each of the outer and inner propulsion devices. In response to the user input, the controller outputs a control signal that trims the outer propulsion devices in the single direction to a first trim angle and trims the inner propulsion device in the single direction to a second trim angle that is different from the first trim angle.

According to another example of the present disclosure, a method for positioning three or more trimmable marine propulsion devices coupled to a transom of a marine vessel is carried out by a controller and includes identifying two propulsion devices located one on each of a port side and a starboard side of a vertical centerline of the transom and spaced symmetrically with respect to the centerline of the transom, and defining the two propulsion devices as outer propulsion devices. The method includes identifying a third propulsion device coupled to the transom between the outer propulsion devices and defining the third propulsion device as an inner propulsion device. The method includes receiving a user input to trim each of the outer and inner propulsion devices in a single direction. In response to the user input, the method includes outputting a control signal that trims each of the outer and inner propulsion devices simultaneously in the single direction for a same amount of time. The controller limits a first rate at which the outer propulsion devices trim in the single direction more than a second rate at which the inner propulsion device trims in the single direction.

According to another example of the present disclosure, a system for a marine vessel includes first and second propulsion devices located one on each of a port side and a starboard side of a vertical centerline of a transom of the marine vessel and spaced symmetrically with respect to the centerline of the transom, and a third propulsion device coupled to the transom between the first and second propulsion devices. A controller defines the first and second propulsion devices as outer propulsion devices and defines the third propulsion device as an inner propulsion device. A user input device is in signal communication with the controller. First, second, and third trim actuators are coupled to and rotate the first, second, and third marine propulsion devices, respectively. The controller is also in signal communication with the first, second, and third trim actuators. In response to a single command from the user input device, the controller outputs control signals to the first and second trim actuators to trim the outer propulsion devices in a given direction to a first trim angle and outputs a control signal to the third trim actuator to trim the inner propulsion device in the given direction to a second trim angle that is different from the first trim angle.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
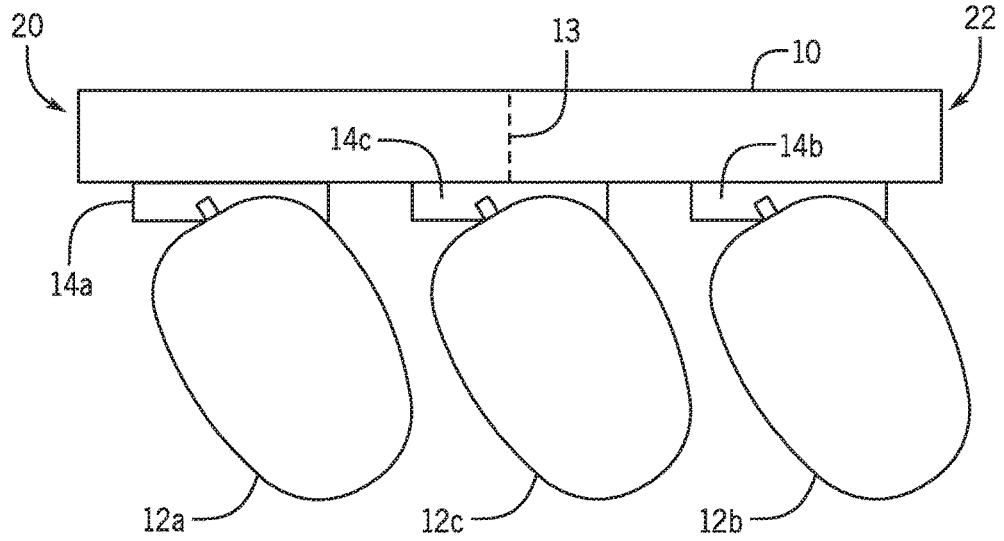
FIG. 1 illustrates one example of a transom of a marine vessel shown from a top view with three outboard motors coupled thereto.
Figure 2:
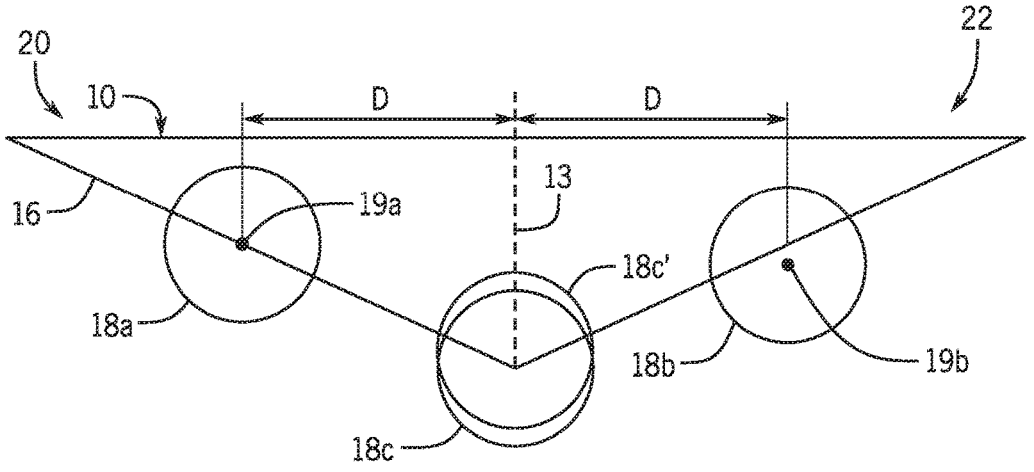
FIG. 2 shows a schematic rear view of a V-shaped transom with three propeller outlines illustrated thereon.
Figure 3:
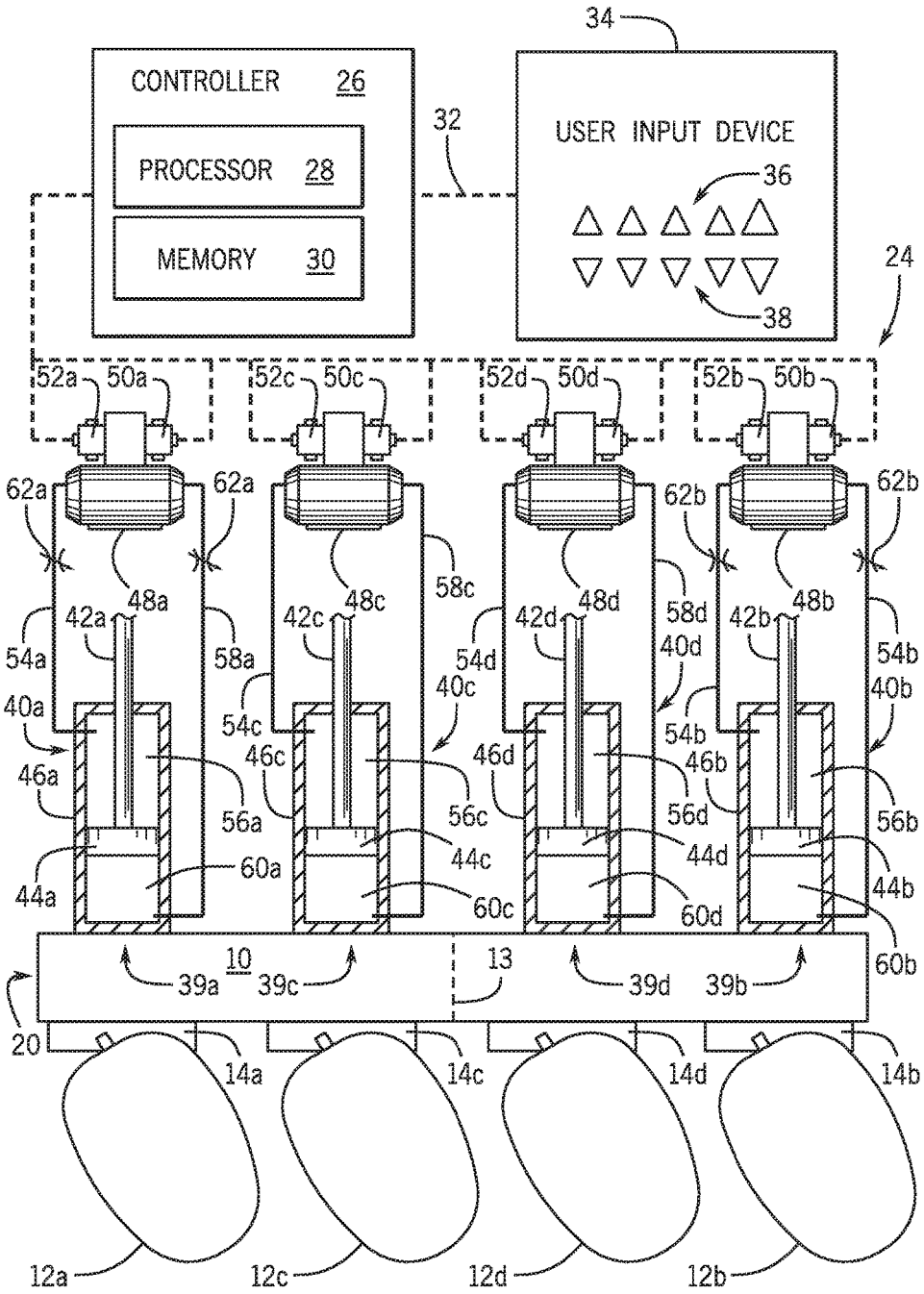
FIG. 3 illustrates a system for controlling trim angles of four outboard motors coupled to a transom of a marine vessel.

FIG. 1 illustrates a transom 10 of a marine vessel to which three marine propulsion devices 12*a*, 12*b*, 12*c* are coupled. Here, each of the propulsion devices 12*a*-12*c* is an outboard motor that is coupled to the transom 10 by way of a mounting bracket 14*a*-14*c*, as known to those having ordinary skill in the art. However, for purposes of the disclosure provided herein, the propulsion devices 12*a*-12*c* could just as well be sterndrives, for example as shown and described in the above-incorporated U.S. Pat. No. 4,776,818. A first propulsion device 12*a* is coupled to the far port side 20 of the transom 10, a second propulsion device 12*b* is coupled to the far starboard side 22 of the transom 10, and a third propulsion device 12*c* straddles a centerline 13 of the transom 10. The propulsion devices are able to be trimmed up and down with respect to the transom 10 by way of trim actuators (such as, but not limited to, hydraulic cylinders, pneumatic cylinders, or electric-linear actuators) to different trim positions as shown in FIGS. 1-3 of the above-incorporated U.S. Pat. No. 7,416,456. Various types, configurations, and functionalities of trim actuators used to provide such rotation are well-known in the art, for example as in U.S. Pat. No. 4,050,359, incorporated by reference above.

The present disclosure provides methods for controlling multiple trim actuators that trim two, three, or more propulsion devices coupled to a transom of a marine vessel, for reasons that will be discussed with respect to FIG. 2. In FIG. 2, a V-shaped hull 16 of a marine vessel is shown schematically with the outlines of three propellers 18*a*, 18*b*, 18*c* outlined as they would appear from a rear view of the transom 10. Because the majority of vessel installs desire the visual aesthetics of propulsion devices that are mounted level with one another, typically, the marine propulsion devices 12*a*-12*b* to which the propellers 18*a*-18*c* are coupled will be installed at the same height on the transom 10. Additionally, the majority of propulsion devices will be mounted symmetrically with respect to the centerline 13 of the transom 10, such that a distance D between the centerline 13 and the rotation axis 19*a*, 19*b* of each propeller 18*a*, 18*b* of a propulsion device 12*a*, 12*b* on either side of the centerline 13 is the same. However, especially for non-flat bottomed hulls, the combination of dead rise, drive separation, and, for example, five-inch gear case increments will typically result in unequal propeller areas working on the water if the propulsion devices are installed level with one another and also trimmed to the same level. This results in less than optimal vessel performance.

For example, in FIG. 2, the device to which propeller 18*a* is coupled is trimmed higher than that to which propeller 18*b* is coupled, and the two propellers 18*a*, 18*b* do not have the same area in the water. Propellers 18*c* and 18*c*' show the same device being trimmed to different levels, where propeller 18*c* is trimmed lower than propeller 18*c*'. The device to which propeller 18*a* is coupled is trimmed the same as that to which propeller 18*c* is coupled, but the two propellers do not have the same area in the water. In contrast, the propellers 18*a* and 18*c*' do have the same area in the water, despite the fact that the device to which propeller 18*c*' is coupled is trimmed to a higher trim position than that of 18*a*. Note also that the propellers 18*b* and 18*c* have the same area in the water, even though they are not trimmed to the same position.

Further, hull designs that include pads, setbacks and/or unique notches can also contribute to the effect that a given propeller will have on producing thrust to propel the marine vessel as well as on adjusting its attitude in the water. Nonetheless, most operators simply use a "trim-all" button (that trims each of the three, four, or more propulsion devices to the same trim position) and accept less than optimized running behavior, or they manually command each propulsion device independently to an optimized trim angle using three or four separate buttons, which takes time and requires a free hand. Not performing this individual trim and thus introducing differential trim between pairs of inner and outer propulsion devices can have negative effects on the performance of the system and can induce additional electromechanical wear. The present inventors realized that because vessels equipped with three or more marine propulsion devices typically benefit from different trim angles between pairs of outer and inner propulsion devices for optimal efficiency, user controls could be provided to achieve differentially trimmed propulsion devices in a faster, easier, and more intuitive way. The present inventors discovered that trimming both devices in a given pair in the same manner is efficient, because each propulsion device in a pair is at the same level on the transom 10 as the other and is equally spaced from the keel. Thus, the propulsion devices in one pair can be treated independently from the propulsion devices in another pair (or from a single, centrally-located propulsion device) without fear of substantially upsetting the roll or steering of the vessel.

For example, FIG. 3 shows an instance in which four propulsion devices 12*a*-12*d* are provided on the transom 10 of a marine vessel by way of mounting brackets 14*a*-14*d*. It can be seen from study of FIG. 2 that it may be desirable to trim up the inner propulsion devices (12*c* and 12*d*) on a V-shaped hull more than the propulsion devices towards the outer edges (12*a* and 12*b*) of a V-shaped hull. (Recall that propellers 18*a* and 18*c*' have the same area in the water and that the device to which propeller 18*c*' is coupled is trimmed to a higher trim position than that of 18*a*.) Trimming the inner propulsion devices 12*c* and 12*d* on a V-shaped hull more than the outer propulsion devices 12*a* and 12*b* (for example, see FIG. 6) would ensure that the propellers of each of the propulsion devices 12*a*-12*d* have a roughly equivalent area in the water and therefore a roughly equivalent effect on positioning and propelling the vessel, all else being equal. Similar principles apply to hulls of different shapes other than that shown herein.

According to the present disclosure, a system and method are provided for accepting a user input to trim each of the outer and inner propulsion devices in a single direction with respect to their current trim angles (i.e., all devices are trimmed up or all are trimmed down), and in response to the user input, outputting a trim control signal with a controller to trim the outer propulsion devices 12*a*, 12*b* in the single direction to a first trim angle and to trim the inner propulsion devices 12*c*, 12*d* in the single direction to a second, different trim angle. This may be done by rate-limiting the trimming of the outer propulsion devices 12*a*, 12*b* in comparison to the trimming of the inner propulsion devices 12*c*, 12*d*. Examples of such a system and several methods for achieving the resulting paired differential trim angles of the propulsion devices will be described herein below.

FIG. 3 shows a schematic of a system 24 associated with the marine vessel. In the example shown, the system 24 includes a controller 26, which is programmable and includes a processor 28 and a memory 30. The controller 26 can be located anywhere in the system 24 and/or located remote from the system 24 and can communicate with various components of the marine vessel via wired and/or wireless links, as will be explained further herein below. Although FIG. 3 shows one controller 26, the system 24 can include more than one controller. For example, the system 24 can have controllers located at or near a helm of the marine vessel and can also have controllers located at or near the propulsion devices 12*a*-12*d*. Portions of the method disclosed herein below can be carried out by a single controller or by several separate controllers. Each controller can have one or more control sections or control units. One having ordinary skill in the art will recognize that the controller 26 can have many different forms and is not limited to the example that is shown and described. For example, a single controller 26 is shown as carrying out the trim control method for all propulsion devices 12*a*-12*d*, but in other examples separate controllers could be provided for each propulsion device.

In some examples, the controller 26 may include a computing system that includes a processing system, storage system, software, and input/output (I/O) interfaces for communicating with devices such as those shown in FIG. 3, and about to be described herein. The processing system loads and executes software from the storage system, such as software programmed with a trim control method. When executed by the computing system, trim control software directs the processing system to operate as described herein below in further detail to execute the trim control method. The computing system may include one or many application modules and one or more processors, which may be communicatively connected. The processing system can comprise a microprocessor (e.g., processor 28) and other circuitry that retrieves and executes software from the storage system. Processing system can be implemented within a single processing device but can also be distributed across multiple processing devices or sub-systems that cooperate in existing program instructions. Non-limiting examples of the processing system include general purpose central processing units, applications-specific processors, and logic devices.

The storage system (e.g., memory 30) can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

In this example, the controller 26 communicates with one or more components of the system 24 via a communication link 32, which can be a wired or wireless link. The controller 26 is capable of monitoring and controlling one or more operational characteristics of the system 24 and its various subsystems by sending and receiving control signals via the communication link 32. In one example, the communication link 32 is a controller area network (CAN) bus, but other types of links could be used. It should be noted that the extent of connections of the communication link 32 shown herein is for schematic purposes only, and the communication link 32 in fact provides communication between the controller 26 and each of the devices described herein, although not every connection is shown in the drawing for purposes of clarity.

In the example shown, the controller 26 receives commands from a user input device 34 such as a keypad or a touchscreen. The user input device 34 includes an interface having "trim up" buttons 36 that command the propulsion devices 12*a*-12*d* to rotate relatively up out of the water and "trim down" buttons 38 that command the propulsion devices 12*a*-12*d* to rotate relatively further down into the water. If the user input device 34 is a touchscreen, it can include buttons in the traditional sense or selectable screen icons. The touchscreen could also display information about the system 24 to the operator of the vessel, such as engine speed, vessel speed, trim angle of each propulsion device, trim operating mode, vessel acceleration rate, etc. An example of the user input device 34 is provided in FIG. 7 and will be described further herein below.

The system 24 also includes first and second propulsion devices 12*a*, 12*b* located one on each of a port side 20 and a starboard side 22 of a vertical centerline 13 of the transom 10 of the marine vessel and spaced symmetrically with respect to the centerline 13 of the transom 10. The controller 26 identifies these propulsion devices 12*a*, 12*b* via the communication link 32 and defines them as outer propulsion devices. Third and fourth propulsion devices 12*c*, 12*d* are also coupled to the transom 10 between the outer propulsion devices 12*a*, 12*b*. The controller 26 defines these as inner propulsion devices. If only one propulsion device is provided between the outer propulsion device 12*a*, 12*b* (see FIG. 1), the controller 26 defines this as a single inner propulsion device 12*c*. It should be understood that each time the inner propulsion devices are referred to in the plural herein below, the description applies equally to a single, central propulsion device unless otherwise noted. Additionally, the same principles discussed herein below apply equally to systems equipped with five or six propulsion devices.

First, second, third, and fourth trim actuators 39*a*-39*d* are coupled to and rotate the first, second, third, and fourth marine propulsion devices 12*a*-12*d*, respectively, about horizontal tilt-trim axes, as is known. In this example, hydraulic piston-cylinders 40*a*-40*d*, in fluid communication with hydraulic pump motors 48*a*-48*d*, are coupled to and rotate the propulsion devices 12*a*-12*d*. Each piston-cylinder 40*a*-40*d* has a rod 42*a*-42*d*, which, on the free end shown, is connected to a respective propulsion device 12*a*-12*d*. The opposite end of each rod 42*a*-42*d* is connected to a piston 44*a*-44*d* that moves within a cylinder 46*a*-46*d* in response to flow of hydraulic fluid from respective first, second, third, and fourth hydraulic pump-motors 48*a*-48*d*. The controller 26 is also in signal communication with the hydraulic pump-motors 48*a*-48*d* and sends control signals to trim-out relays 50*a*-50*d* or trim-in relays 52*a*-52*d* to switch flow of hydraulic fluid through the hydraulic pump-motors 48*a*-48*d*. The controller 26 controls energizing of solenoids in the relays 50*a*-50*d* and 52*a*-52*d*, which act as switches to couple a power source such as a battery (not shown) to the pump-motors 48*a*-48*b*. In other examples, the trim-in relays 52*a*-52*d* and the trim-out relays 50*a*-50*d* are each a single relay that can turn an individual pump-motor 48-48*d* on or off. In still another example, the piston-cylinders are electrically-actuated, and the trim-in relays 52*a*-52*d* and the trim-out relays 50*a*-50*d* can effect a trim-in or trim-out movement of the piston-cylinders 40*a*-40*d* directly.

First hydraulic lines 54*a*-54*d* couple the pump-motors 48*a*-48*d* to first chambers 56*a*-56*d* of the piston-cylinders 40*a*-40*d*, and second hydraulic lines 58*a*-58*d* couple the pump-motors 48*a*-48*d* to second chambers 60*a*-60*d* of the piston-cylinders 40*a*-40*d*. As long as the trim-in relays 52*a*-52*d* are activated, the pump-motors 48*a*-48*d* provide hydraulic fluid through the first hydraulic lines 54*a*-54*d* to the first chambers 56*a*-56*d* of the piston-cylinders 40*a*-40*d*, thereby pushing the pistons 44*a*-44*d* downwardly within the cylinders 46*a*-46*d* and lowering (trimming in) the propulsion devices 12*a*-12*d* coupled to the rods 42*a*-42*d*. As long as the trim-out relays 50*a*-50*d* are activated, the pump-motors 48*a*-48*c* provide hydraulic fluid through the second hydraulic lines 58*a*-58*d* to the second chambers 60*a*-60*c* of the piston-cylinders 40*a*-40*c*, thereby pushing the pistons 44*a*-44*c* upwardly within the cylinders 46*a*-46*c* and raising (trimming out) the propulsion devices 12*a*-12*d* coupled to the rods 42*a*-42*d*. Hydraulic fluid can be removed from the opposite chambers 56*a*-56*d* or 60*a*-60*d* of the cylinders 46*a*-46*d* into which fluid is not being pumped in either instance, and drained to a tank or re-circulated through the pump-motors 48*a*-48*d*.

Figure 4:
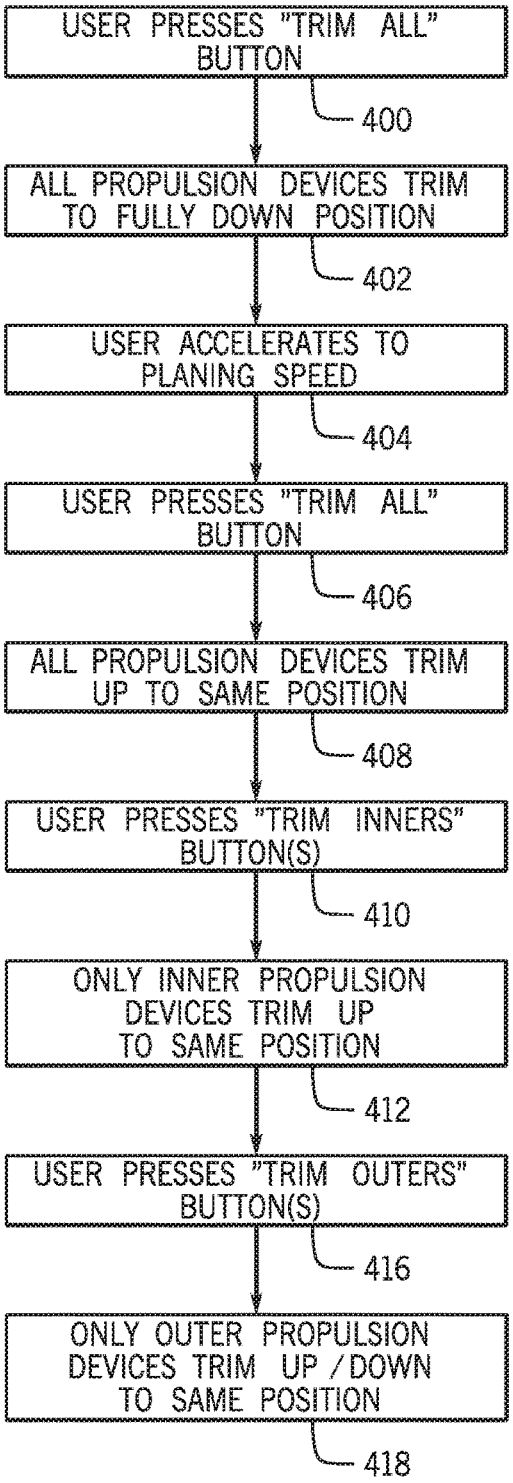
FIG. 4 PRIOR ART
FIG. 4 illustrates a prior art method for trimming three or more marine propulsion devices.
Figure 7:
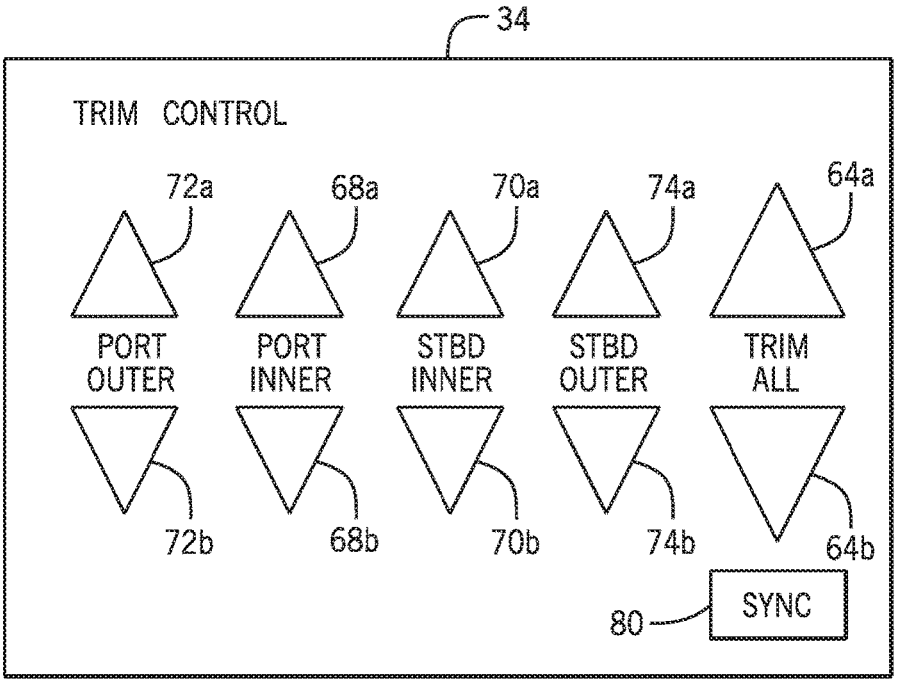
FIG. 7 shows an example of a user input device for inputting trim commands.

Referring now to FIGS. 4 and 7, according to prior art systems and methods, to prepare for launch, an operator would first press a trim-all down button 64*b*, as shown at 400, while operating at low or idle speeds. As shown at 402, the outer propulsion devices 12*a*, 12*b* and inner propulsion devices 12*c*, 12*d* would thereafter simultaneously trim to the same trim angle, which in this is example is fully down, in preparation for launch. The operator would then accelerate to planing speed, as shown at 404. After planing speed is reached, he would then press a trim-all up button 64*a* as shown at 406 to simultaneously trim all of the propulsion devices 12*a*-12*d* to a single trim position calibrated for relatively better performance of the vessel, considering the constraint that all propulsion devices would be trimmed to the same position, as shown at 408. If the operator wished to adjust the trim for either the inner or outer propulsion devices separately beyond this position, he would next press two or more separate buttons in order to trim just the inner or just the outer propulsion devices. For example, he would press two or more trim up buttons 68*a*, 70*a*, as shown at 410, to trim the inner propulsion devices 12*c*, 12*d*, as shown at 412. He would also need to press two or more trim up buttons 72*a*, 74*a*, as shown at 416, to trim the outer propulsion devices 12*a*, 12*b*, as shown at 418. Thus, it can be seen that while the use of a button such as the trim-all up button 64*a* as shown at 406 makes operation somewhat easier for an inexperienced operator, the concurrent acts of steering and throttling the vessel result in few free additional movements available to input subsequent trim commands. Therefore, when a more experienced operator desired to trim pairs of propulsion devices separately after using the trim-all up button 64*a* as shown at 406, he would need to leave one of the pairs of propulsion devices at the original trim-all position while he used a free hand to trim the other pair. This resulted in less than optimal performance of the vessel, and required a number of distinct steps.

Figure 5:
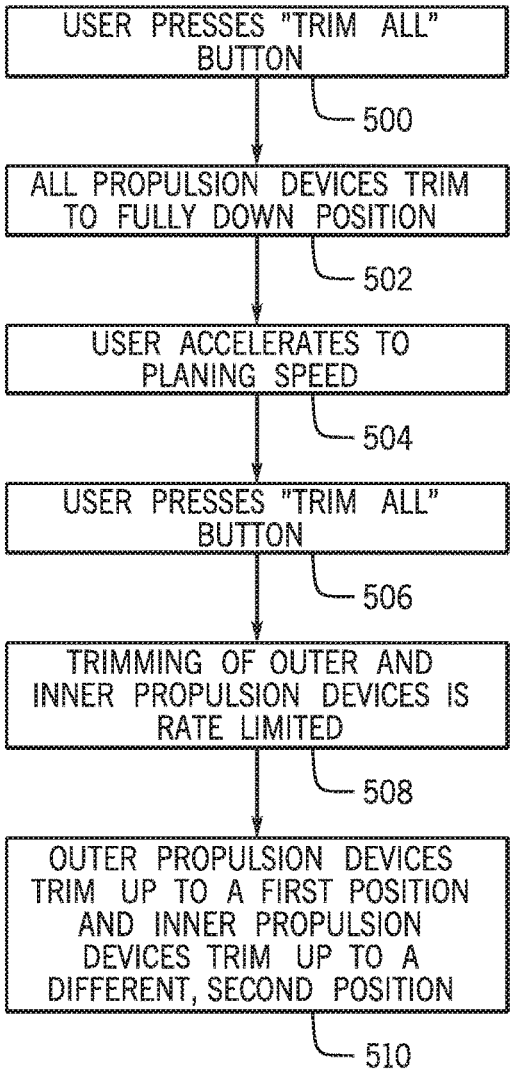
FIG. 5 illustrates a method according to the present disclosure for trimming three or more marine propulsion devices.
Figure 6:
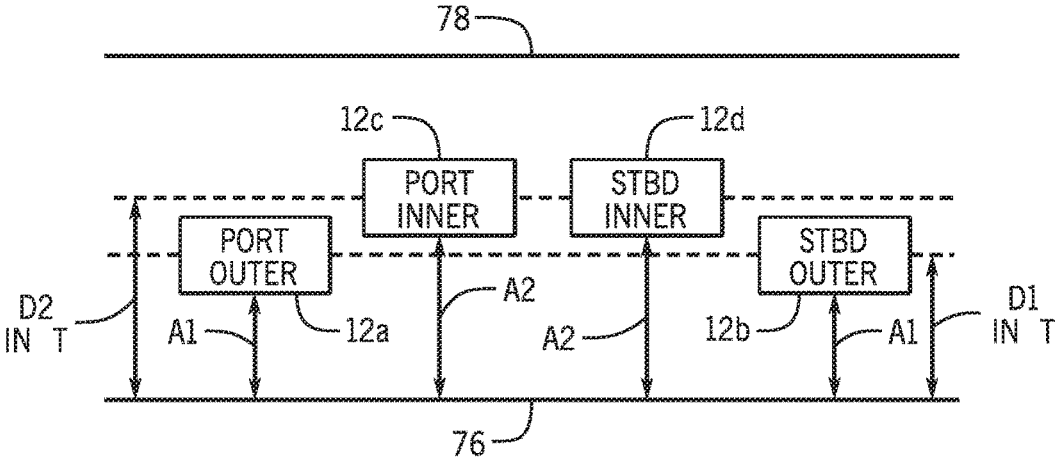
FIG. 6 is a schematic showing trimming of four propulsion devices.

In contrast, according to the method proposed herein and shown in FIG. 5, selection of a single button will trim a pair of propulsion devices to a trim angle that is unique from the other pair of propulsion devices' trim angle. According to the present method, while operating in idle or at low speeds, an operator may select a button such as the trim-all down button 64*b* as shown at 500. Thereafter, the outer propulsion devices 12*a*, 12*b* and inner propulsion devices 12*c*, 12*d* will be trimmed to the same fully down position, as shown at 502. As the operator accelerates to planing speed, a new process for adjusting trim for all of the propulsion devices 12*a*-12*d* simultaneously such that optimal performance is achieved can be initiated by pressing a single trim-all up button 64*a*, as shown at 506. In response to the single user input, the controller 26 can output a control signal that achieves differentially trimmed pairs of propulsion devices in one of a few ways. One example is by rate limiting trimming of the outer propulsion devices 12*a*, 12*b* separately from the inner or single propulsion device(s) 12*c*, 12*d* such that the propulsion devices 12*a*-12*d* trim in pairs at different rates. This is shown at 508 in FIG. 5. The rates can be set such that the pairs reach different trim angles simultaneously. The end result, however, is that the outer pair of propulsion devices 12*a*, 12*b* is trimmed to a first trim angle and the inner pair (or single) propulsion device(s) 12*c*, 12*d* is/are trimmed to a second trim angle that is different from the first trim angle, as shown at 510. In one example, as shown in FIG. 6, the first trim angle A1 as measured from a fully down position 76 is less than the second trim angle A2 as measured from the fully down position 76, where 78 represents an upper trim angle limit.

The method disclosed may be enabled only while the vessel is underway, where it is of use to reduce electromechanical wear on the components associated with trimming the marine propulsion devices 12*a*-12*d*. For example, the method may include outputting the control signal in response to the user input only if the marine vessel is operating above a threshold speed upon receipt of the user input. The threshold speed might be, for example, approximately the planing speed calibrated for that particular vessel. In other words, the method would not necessarily be able to be performed at idle or key-on/engine-off. Additionally, it should be noted that the methods described herein can be implemented completely separately from a full auto-trim control method, in which propulsion devices are automatically trimmed to given setpoints depending on vessel or engine speed. Rather, the methods described herein are carried out in response to commands input manually via the user input device 34 (FIG. 7).

Different devices and/or programming can be introduced into the system 24 to manipulate the signal between the controller 26 and the trim system in such a way that the result is differently-trimmed pairs of propulsion devices. For example, ways to implement a rate limiter will now be described. While the below examples are discussed with respect to hydraulic trim cylinders, those having skill in the art will realize that corresponding devices and methods exist for rate-limiting pneumatically or electrically actuated trim cylinders. One rate-limiting method is a pulse width modulation (PWM) method, in which the controller 26 pulse width modulates the control signal from the controller 26 to the hydraulic pump-motors 48*a*-48*d* such that first and second PWM signals controlling the respective first and second hydraulic pump-motors 48*a*, 48*b* are the same as one another, but are different from a third PWM signal controlling the third hydraulic pump-motor 48*c* and from a fourth PWM signal controlling the fourth hydraulic pump-motor 48*d*. Note that the third and fourth PWM signals would be the same as one another. In this example, the duty cycle of the signals sent to the first and second hydraulic pump-motors 48*a*, 48*b* would be less than the duty cycle of the signals sent to the third and fourth hydraulic pump-motors 48*c*, 48*d*.

Another example is by buffering the hydraulic system, such as by introducing hydraulic rate limiters for each trim actuator (e.g. variable orifices, variable flow control valves, fixed orifices) that control the flow of hydraulic fluid from the pump-motors 48*a*-48*d* to the piston-cylinders 40*a*-40*c*. For example, hydraulic rate limiters (see first and second hydraulic rate limiters 62*a*, 62*b*, FIG. 3) could be provided for a pair (or all) of the respective first, second, third, and fourth hydraulic piston-cylinders 40*a*-40*d*. The controller could control the size of the orifices (or the orifices could be fixed at different sizes) such that first and second flows of hydraulic fluid to the respective first and second hydraulic piston-cylinders 40*a*, 40*b* are limited differently than third and fourth flows of hydraulic fluid to the third and fourth hydraulic piston-cylinders 40*c*, 40*d*. In this example, flow to the first and second hydraulic piston-cylinders 40*a*, 40*b* would be less than flow to the third and fourth hydraulic piston-cylinders 40*c*, 40*d*.

Another example is by buffering the electrical signal or the power to the pump-motors 48*a*-48*c*, such as by providing different voltages (for example by using a voltage buffer amplifier) to each of the motors controlling the trim pumps. For example, the controller 26 could supply first and second voltages to the respective first and second hydraulic pump-motors 48*a*, 48*b* that are the same as one another, and could supply third and fourth voltages to the third and fourth hydraulic pump-motors 48*c*, 48*d* that are different from the first and second voltages. Note that the third and fourth voltages would be the same as one another. In this example, voltage to the first and second hydraulic piston-cylinders 40*a*, 40*b* would be less than voltage to the third and fourth hydraulic piston-cylinders 40*c*, 40*d*.

The controller 26 can be programmed such that the propulsion devices 12*a*-12*d* trim simultaneously. For example, referring to FIG. 6, the present method can include trimming both the inner propulsion devices 12*c*, 12*d* and the outer propulsion devices 12*a*, 12*b* for the same amount of time, but at different rates. The time it takes for the outer propulsion devices 12*a*, 12*b* to reach the first trim angle A1 may be the same as the time it takes for the inner propulsion devices 12*c*, 12*d* to reach the second trim angle A2, but the distance to reach the first trim angle A1 is not equal to the distance to reach the second trim angle A2. This shown by the inner propulsion devices 12*c*, 12*d* traveling a distance D2 from the fully down position 76 in the same amount of time T as the outer propulsion devices 12*a*, 12*b* travel a shorter distance D1. Thus, the method may include trimming the outer propulsion devices 12*a*, 12*b* in the single direction at a first rate, and trimming the inner propulsion devices 12*c*, 12*d* in the single direction at a second rate that is faster than the first rate. This method need not include a feedback loop to achieve the desired trim angles, but could be controlled in an open loop manner.

Referring to FIGS. 3 and 7, the controller 26 can be programmed such that a single touch of one of the trim-all buttons 64*a* or 64*b* trims the propulsion devices 12*a*-12*d* up or down for a pre-determined given amount of time. For example, a single touch of one of the trim-all buttons 64*a* or 64*b* might energize the trim relays 50*a*-50*d* or 52*a*-52*d* for a given number of seconds. In another example, the controller 26 may be programmed such that it generates and outputs the control signal in response to a single user input for as long as the user input is received. In other words, the controller 26 may activate the trim-in relays 52*a*-52*d* or trim-out relays 50*a*-50*d* for as long as the operator's finger remains on one of the trim-all buttons 64*a* or 64*b*. Both of the above methods would be controlled in an open loop manner. The controller 26 may trim the propulsion devices consecutively, such that one pair trims before the other, or may trim the propulsion devices simultaneously, as described with respect to FIG. 6. In yet another example, the controller 26 does not trim the propulsion devices for the same amount of time, but rather for a given amount of time each, yet at the same rate, again using open loop control. In still another example, the controller 26 delays trimming the outer propulsion devices 12*a*, 12*b* up in response to actuation of the trim-all up button 64*a* by a given amount of time, in order that when the outer propulsion devices 12*a*, 12*b* do begin trimming at the same rate as the inners, they do not trim to as high an angle as the inner propulsion devices 12*c*, 12*d* trim.

The process for determining the trim angles to which each of the propulsion devices 12*a*-12*d* is to be trimmed is not a focus of the present disclosure. There are numerous prior art methods for determining differential trim position setpoints. Ideally, the trim angle differential between inner and outer pairs of propulsion devices will be calibrated per vessel, and stored in the memory 30 of the controller 26 for that particular vessel. In other examples, the angle differential might be able to be set by the operator via the user input device 34. Nonetheless, the methods disclosed herein can be considered to cover comparison of desired trim setpoint angles between the outer and inner pairs with one another. Benefits of such a method include less battery usage and less trim system deterioration due to trim stall. For example, if all propulsion devices 12*a*-12*d* are programmed to reach a fully down trim angle at approximately the same time as one another when trim-down is initiated, it is unlikely any one of the trim systems will stall due to inability to reach the setpoint.

In another example, the user input device 34 includes a "sync" button 80 (FIG. 7) that allows the operator to turn the differential trim capabilities on and off. If the differential trim capabilities are turned off, the operator can use the trim-all buttons 64*a*, 64*b* in the usual manner, to trim each of the three or four propulsion devices simultaneously at the same rate and to the same trim angle.

Figure 8:
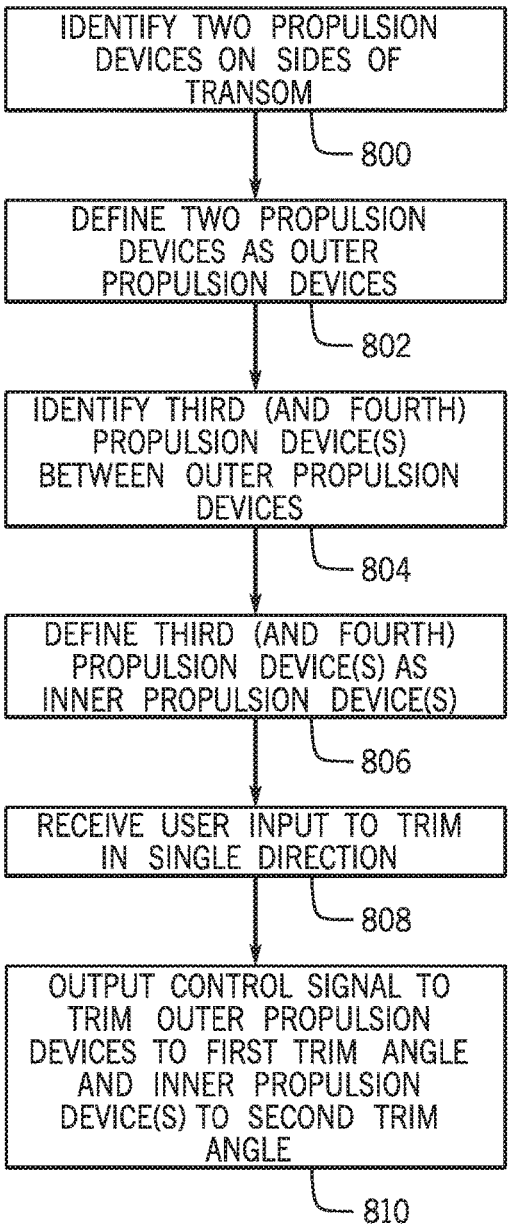
FIG. 8 illustrates another method according to the present disclosure for trimming three or more marine propulsion devices.

Therefore, one method according to the present disclosure is shown in FIG. 8, and includes identifying two propulsion devices 12*a*, 12*b* located one on each of a port side 20 and a starboard side 22 of a vertical centerline 13 of the transom 10 and spaced symmetrically with respect to the centerline 13 of the transom 10, as shown at 800. The method includes defining the two propulsion devices 12*a*, 12*b* as outer propulsion devices, as shown at 802. The method also includes identifying a third propulsion device 12*c* coupled to the transom 10 between the outer propulsion devices 12*a*, 12*b*, as shown at 804, and defining the third propulsion device 12*c* as an inner propulsion device, as shown at 806. If a fourth propulsion device 12*d* is provided on the transom 10, the fourth propulsion device 12*d* is also identified and defined as an inner propulsion device. At 808, a user input is received to trim each of the outer and inner propulsion devices 12*a*-12*d* in a single direction with respect to current trim angles of each of the outer and inner propulsion devices 12*a*-12*d*. In response to the user input, a controller 26 outputs a control signal that trims the outer propulsion devices 12*a*, 12*b* in the single direction to a first trim angle D1 and trims the inner propulsion devices 12*c*, 12*d* in the single direction to a second trim angle D2 that is different from the first trim angle D1, as shown at 810. See also FIG. 6.

Figure 9:
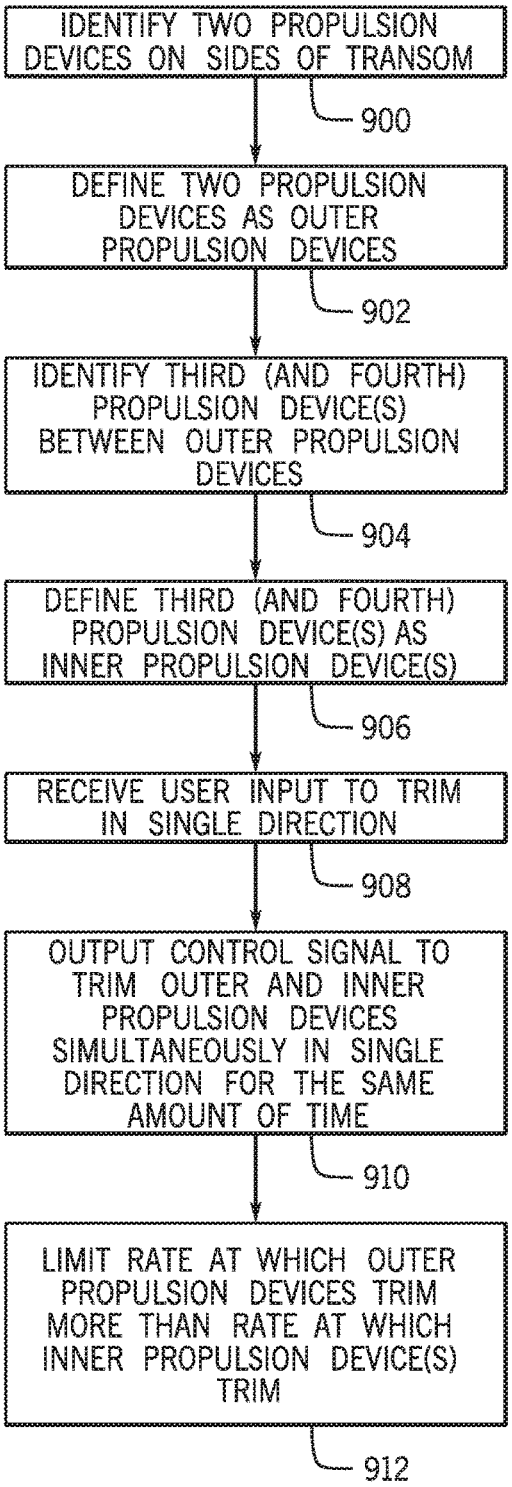
FIG. 9 illustrates yet another method according to the present disclosure for trimming three or more marine propulsion devices.

Another method according to the present disclosure is shown in FIG. 9. A controller 26 identifies two propulsion devices 12*a*, 12*b* located one on each of a port side 20 and a starboard side 22 of a vertical centerline 13 of the transom 10 and spaced symmetrically with respect to the centerline 13 of the transom 10, as shown at 900, and defines the two propulsion devices 12*a*, 12*b* as outer propulsion devices, as shown at 902. The method includes identifying a third propulsion device 12*c* coupled to the transom 10 between the outer propulsion devices 12*a*, 12*b*, as shown at 904, and defining the third propulsion device 12*c* as an inner propulsion device, as shown at 906. If a fourth propulsion device

12*d* is provided on the transom 10, the fourth propulsion device 12*d* is also identified and defined as an inner propulsion device. The method includes receiving a user input to trim each of the outer and inner propulsion devices 12*a*-12*d* in a single direction, as shown at 908. In response to the user input, the method includes outputting a control signal that trims each of the outer and inner propulsion devices 12*a*-12*d* simultaneously in the single direction for a same amount of time, as shown at 910. The controller 26 limits a first rate at which the outer propulsion devices 12*a*, 12*b* trim in the single direction more than a second rate at which the inner propulsion devices 12*c*, 12*d* trim in the single direction, as shown at 912.

Thus far, the method has been discussed and described with respect to trimming the propulsion devices 12*a*-12*d* up from their fully down position once the vessel is on-plane. However, similar principles apply to trimming the propulsion devices down while underway. If the trim angles of the propulsion devices need to be adjusted due to water conditions or vessel loading conditions while the vessel is underway in order to provide better visibility or a smoother ride, the paired differential trimming can still be maintained. For instance, in response to actuation of the trim-all down button 64*b* (FIG. 7), the controller 26 may cause the inner propulsion devices 12*c*, 12*d* to trim down at a rate that is faster than that at which the outer propulsion devices 12*c*, 12*d* trim down. Ideally, the rates at which the propulsion devices trim down would have the same ratio as the ratio between the rates at which they trimmed up. This way, the inner propulsion devices 12*c*, 12*d* will remain relatively higher in the water than the outer propulsion devices 12*a*, 12*b*, at least while the vessel is still planing. Trimming the inner propulsion devices 12*c*, 12*d* down faster will also allow them to reach the fully down position at the same time as the outer propulsion devices 12*a*, 12*b*, as noted above, in response to the operator commanding this once the vessel is no longer planing.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A method for positioning at least three trimmable marine propulsion devices coupled to a transom of a marine vessel, the method being carried out by a controller and comprising:

identifying two propulsion devices located one on each of a port side and a starboard side of a vertical centerline of the transom and spaced symmetrically with respect to the centerline of the transom;

defining the two propulsion devices as outer propulsion devices;

identifying a third propulsion device coupled to the transom between the outer propulsion devices;

defining the third propulsion device as an inner propulsion device;

receiving a user input to trim each of the outer and inner propulsion devices in a single direction with respect to current trim angles of each of the outer and inner propulsion devices; and in response to the user input, outputting a control signal; and in response to the control signal, trimming the outer propulsion devices in the single direction to a first trim angle and trimming the inner propulsion device in the single direction to a second trim angle that is different from the first trim angle.

2. The method of claim 1, wherein the first trim angle is less than the second trim angle.

3. The method of claim 2, further comprising trimming the outer propulsion devices in the single direction at a first rate, and trimming the inner propulsion device in the single direction at a second rate that is faster than the first rate.

4. The method of claim 3, further comprising trimming both the inner propulsion device and the outer propulsion devices for a same amount of time.

5. The method of claim 3, wherein the outer propulsion devices are respectively coupled to first and second hydraulic piston-cylinders controlled by respective first and second flows of hydraulic fluid from respective first and second hydraulic pump-motors, and the inner propulsion device is coupled to a third hydraulic piston-cylinder controlled by a third flow of hydraulic fluid from a third hydraulic pump-motor.

6. The method of claim 5, further comprising pulse width modulating the control signal such that first and second pulse width modulated (PWM) signals controlling the respective first and second hydraulic pump-motors are the same as one another, but are different from a third PWM signal controlling the third hydraulic pump-motor.

7. The method of claim 5, further comprising supplying first and second voltages to the respective first and second hydraulic pump-motors that are the same as one another, and supplying a third voltage to the third hydraulic pump-motor that is different from the first and second voltages.

8. The method of claim 5, further comprising providing first, second, and third hydraulic rate limiters for each of the respective first, second, and third hydraulic piston-cylinders, and limiting the first and second flows of hydraulic fluid to the respective first and second hydraulic piston-cylinders differently than the third flow of hydraulic fluid to the third hydraulic piston-cylinder.

9. The method of claim 1, wherein a fourth propulsion device is coupled to the transom of the marine vessel between the outer propulsion devices, and further comprising:

defining the third and fourth propulsion devices as inner propulsion devices; and in response to the user input, outputting the control signal, in response to which the inner propulsion devices are trimmed in the single direction to the second trim angle.

10. The method of claim 1, further comprising trimming each of the inner and outer propulsion devices simultaneously in response to the control signal.

11. The method of claim 1, further comprising generating and outputting the control signal in response to a single user input for as long as the single user input is received.

12. The method of claim 1, further comprising outputting the control signal in response to the user input only if the marine vessel is operating above a threshold speed upon receipt of the user input.

13. A method for positioning at least three trimmable marine propulsion devices coupled to a transom of a marine vessel, the method being carried out by a controller and comprising:

identifying two propulsion devices located one on each of a port side and a starboard side of a vertical centerline of the transom and spaced symmetrically with respect to the centerline of the transom;

defining the two propulsion devices as outer propulsion devices;

identifying a third propulsion device coupled to the transom between the outer propulsion devices;

defining the third propulsion device as an inner propulsion device;

receiving a user input to trim each of the outer and inner propulsion devices in a single direction;

in response to the user input, outputting a control signal;

in response to the control signal, trimming each of the outer and inner propulsion devices simultaneously in the single direction for a same amount of time; and limiting a first rate at which the outer propulsion devices trim in the single direction more than a second rate at which the inner propulsion device trims in the single direction.

14. The method of claim 13, wherein the outer propulsion devices are respectively coupled to first and second hydraulic piston-cylinders controlled by respective first and second flows of hydraulic fluid from respective first and second hydraulic pump-motors, and the inner propulsion device is coupled to a third hydraulic piston-cylinder controlled by a third flow of hydraulic fluid from a third hydraulic pump-motor.

15. The method of claim 14, further comprising pulse width modulating the control signal such that first and second pulse width modulated (PWM) signals controlling the respective first and second hydraulic pump-motors are the same as one another, but are different from a third PWM signal controlling the third hydraulic pump-motor.

16. The method of claim 14, further comprising supplying first and second voltages to the respective first and second hydraulic pump-motors that are the same as one another, and supplying a third voltage to the third hydraulic pump-motor that is different from the first and second voltages.

17. The method of claim 14, further comprising providing first, second, and third hydraulic rate limiters for each of the respective first, second, and third hydraulic piston-cylinders, and limiting the first and second flows of hydraulic fluid to the respective first and second hydraulic piston-cylinders differently than the third flow of hydraulic fluid to the third hydraulic piston-cylinder.

18. The method of claim 13, further comprising generating and outputting the control signal in response to a single user input for as long as the single user input is received.

19. The method of claim 13, further comprising outputting the control signal in response to the user input only if the marine vessel is operating above a threshold speed upon receipt of the user input.

20. A system for a marine vessel, the system comprising:

first and second propulsion devices located one on each of a port side and a starboard side of a vertical centerline of a transom of the marine vessel and spaced symmetrically with respect to the centerline of the transom;

a third propulsion device coupled to the transom between the first and second propulsion devices;

a controller that defines the first and second propulsion devices as outer propulsion devices and defines the third propulsion device as an inner propulsion device;

a user input device in signal communication with the controller; and first, second, and third trim actuators coupled to and rotating the first, second, and third propulsion devices, respectively;

wherein the controller is in signal communication with the first, second, and third trim actuators; and wherein in response to a single command from the user input device, the controller outputs control signals to the first and second trim actuators, which thereafter trim the outer propulsion devices in a given direction to a first trim angle, and the controller outputs a control signal to the third trim actuator, which thereafter trims the inner propulsion device in the given direction to a second trim angle that is different from the first trim angle.

* * * * *